United States Patent [19]

Oldham

[11] 3,972,581

[45] Aug. 3, 1976

[54] UNDERWATER ELECTRICAL CONNECTOR

[75] Inventor: Ronald C. Oldham, Chandlers Ford, England

[73] Assignee: International Standard Electric Corporation, New York, N.Y.

[22] Filed: May 1, 1975

[21] Appl. No.: 573,751

[30] Foreign Application Priority Data

July 4, 1974 United Kingdom..... 29906/74

[52] U.S. Cl...... 339/96; 339/117 R

[51] Int. Cl.²..... H01R 16/52

[58] Field of Search..... 339/94, 96, 117

[56] References Cited

UNITED STATES PATENTS

| | | | |
|---|---|---|---|
| 3,508,188 | 4/1970 | Buck | 339/117 R |
| 3,643,207 | 2/1972 | Cairns | 339/96 |
| 3,714,384 | 1/1973 | Burkhardt et al. | 339/96 |

FOREIGN PATENTS OR APPLICATIONS

| | | | |
|---|---|---|---|
| 274,176 | 6/1970 | U.S.S.R. | 339/96 |

*Primary Examiner*—Joseph H. McGlynn
*Attorney, Agent, or Firm*—Thomas L. Peterson

[57] ABSTRACT

An electrical connector which can be safely used under water. The conductor pins of one-half of the connector are engageable with sockets in the other half of the connector. The sockets are disposed in a cavity filled with a semi-mobile compound. The pins pass through a self-sealing diaphragm before entering the cavity and engaging the sockets. Pressurizing means is provided in the cavity to compensate for any loss of the compound during usage of the connector.

5 Claims, 2 Drawing Figures

1
2
3
4
5
5a
6
7
8
9
10
11
12
13
14
15
16
17
18
19
20
20a
20b
21
22
23
24
25
26
27
28
29
30
31
32
33
34
35
36
37
38
39
40

UNDERWATER ELECTRICAL CONNECTOR

BACKGROUND OF THE INVENTION

This invention relates generally to an electrical connector, and, more particularly, to an electrical connector which may be used under water.

The invention relates to an underwater connector which can be connected and disconnected while in water or other liquid media, such as disclosed in U.S. Pat. No. 3,643,207. The prior art connector comprises a first part provided with one or more electrically conductive pin contacts and a second part provided with corresponding electrical socket contacts. The socket contacts are immersed in a semi-mobile nonelectrically-conducting compound in a cavity. The cavity is closed by a diaphragm which is penetrable by the corresponding pin contacts of the first part when connecting the parts together. Mating and unmating of the connector parts, as well as long time use of the connector under water, results in some of the semi-mobile compound in the cavity being lost, which can result in water entering the cavity to cause short circuits. The purpose of the invention is to overcome or at least minimize this problem.

SUMMARY OF THE INVENTION

According to the present invention, there is provided an underwater electrical connector including mating first and second connector members. The first connector member is provided with one or more electrically conducting pins extending therefrom, and the second connector member is provided with a corresponding electrical socket for each pin with which the pin is engageable. Each socket extends into one end of a cavity formed in the second connector member. The other end of the cavity is closed by a diaphragm which is penetrable by each pin during mating of the first and second connector members. The cavity is filled with a semi-mobile nonelectrically-conducting compound. Pressurizing means is provided for reducing the volume of the cavity to compensate for any loss of compound therefrom during normal usage of the connector.

DESCRIPTION OF THE PREFERRED EMBODIMENTS

Figures 1, 2:
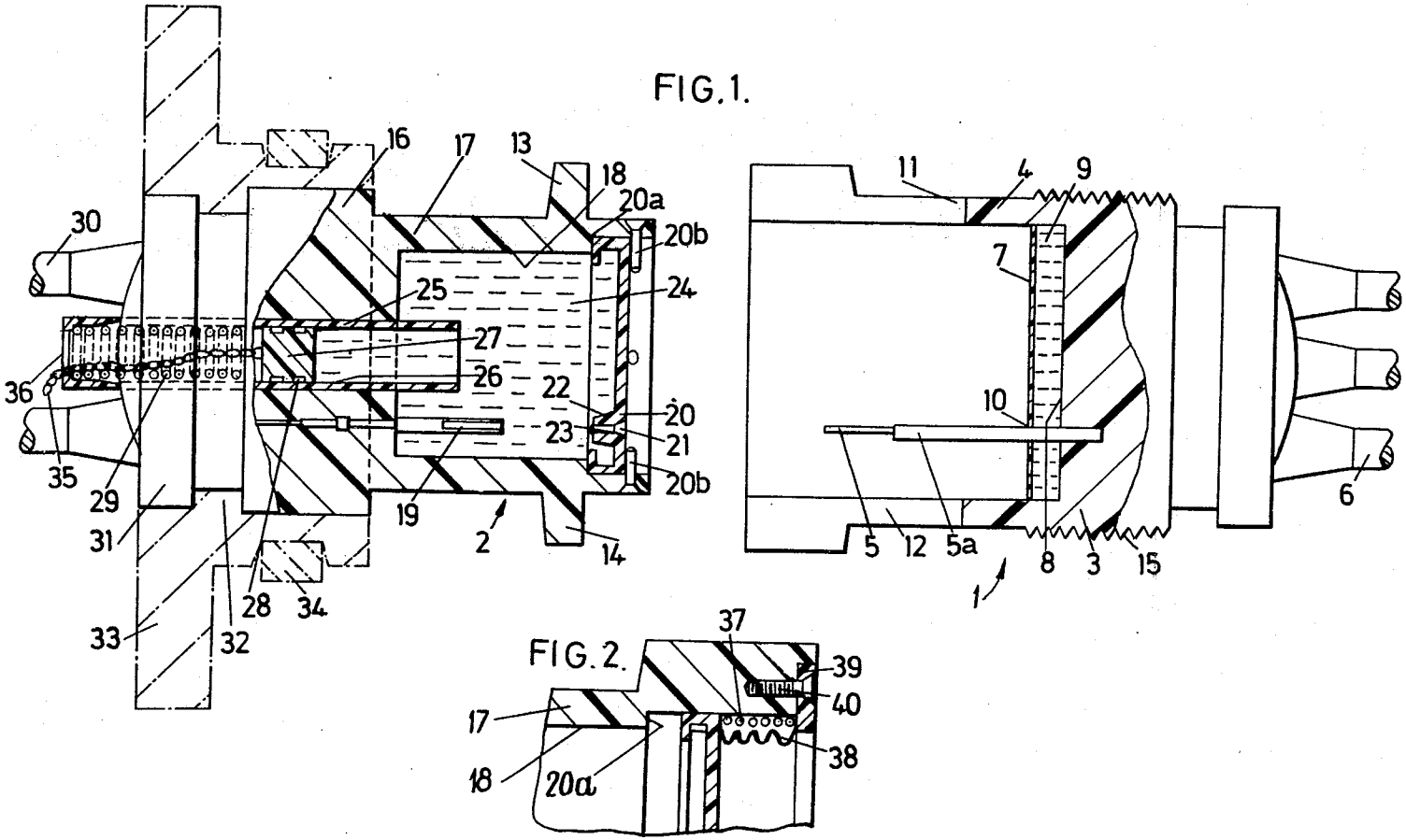
FIG. 1 shows a two-part connector, partly in section, incorporating one embodiment of the pressuring means of the invention with the connector parts shown unmated.
FIG. 2 is a fragmentary, sectional view of an alternative embodiment of the pressurizing means.

Referring to FIG. 1 of the drawing the connector comprises a first connector member 1 and a mating second connector member 2. The connector member 1 comprises a housing 3 having an integral sleeve 4 made from a molded plastic or elastomeric material, for example polyethylene. It could instead be of polyurethane or polychloroprene rubber. Secured in the housing 3 are a plurality of contacts in the form of contact pins 5 made, for example, of beryllium copper and insulated with insulation **5*a* over a part of their length. At their other ends the contact pins 5 are connected to cables such as 6 (the connection not being shown in the drawing) sealed with respect to the housing 3.**

For simplicity only one contact pin has been shown but there would be typically four — there could be less or there could be more. A diaphragm 7 of, e.g., polyethylene encloses between itself and the bottom 8 of the sleeve 4, some electrically insulating semi-mobile compound 9, to minimize possible electrical stress at the base of the pins 5. The diaphragm 7 has apertures 10 allowing the contact pins 5 to pass therethrough.

The sleeve 4 has locating slots 11 and 12 for locating corresponding lugs 13 and 14 on the connector member 2, ensuring correct alignment of the parts during the connection operation. Other mechanical means can be used to ensure correct location during connection.

Some non-slip grooves 15 are formed on the outer surface of the housing 3 to enable a satisfactory manual grip on the housing for connecting and disconnecting it with the connector member 2.

The connector member 2 comprises a housing 16 having a sleeve 17 defining a cavity 18 housing a plurality of contacts in the form of socket contacts 19. The sleeve 17 is dimensioned radially to have a snug sliding fit inside the sleeve 4 of the connector member 1.

A diaphragm 20 is seated across the entrance to the cavity 18 and has a plurality of apertures 21, one for each of the contact pins 5 to pass through the diaphragm when the two parts of the connector are connected together. The aperture 21 extends through a nipple 22 of the diaphragm, the tip of which has a thin flexible closure membrane 23. When the parts 1 and 2 are disconnected, the membrane 23 effectively wipes electrically insulating semi-mobile compound 24 from contact pins 5 and insulation **5*a* and seals the cavity 18** against egress of the compound therefrom. This in turn limits ingress of water to a minimum when the connector is submerged.

A tube or cylinder 25 opens into the cavity 18 and extends through the housing 16. This tube provides a reservoir 26 for the semi-mobile compound 24 and contains a piston 27. The piston has sealing rings 28 or other means of sealing against loss of compound. The piston is biased toward the cavity 18 by a compression spring 29 to thus maintain the cavity pressurized.

Cables 30 are sealed to the housing 17 and are connected to the socket contacts 19 within the housing.

The housing has an external annular groove 31 in which is seated a mating annular projection 32 of a bulkhead mounting attachment 33 for mounting the connector member 2 on a bulkhead. A locking ring 34 maintains the attachment 33 on the housing 16.

After a large number of connecting and disconnecting operations of the connector, it is possible that some semi-mobile compound 24 is lost from the cavity 18, for example by adhering to the pins 5 and insulation **5*a* each time the connector is disconnected. The resiliently biased piston 27 causes any loss of compound from the cavity 18 to be made up from the reservoir 26. Thus, in effect, the pressurizing means reduces the total volume of the cavity 18 and reservoir 26 to compensate for losses of compound 24 from the connector 2.**

It should be noted that the side of the piston 27 remote from the chamber 18 is subject to external pressure via a breather hole 36 in that end of the tube 25. A small chain 35 or a screwed rod (not shown) extends through the hole 36 from the piston 27, and is used for drawing the piston back during filling the cavity 18 with the semi-mobile compound. It can be seen that the diaphragm 20 is held in a recess **20*a* by screws 20*b* which are removable from the end of the sleeve 17** so that if necessary the diaphragm can be removed and replaced by a new one.

An alternative to the use of spring 29 in tube 25 on the connector member 2 is shown in FIG. 2. The sleeve 17 is made longer by increasing the depth of recess 20*a* at the entrance to chamber 18. A spring 37 held in position by screws 20*b* and retaining ring 39 causes the diaphragm 20 to be constantly in contact with the surface of the semi-mobile compound 24. The effect of any loss of semi-mobile compound 24 is negated by reducing the volume of chamber 18 by the inward movement of diaphragm 20 caused by the pressure exerted by spring 37. A bellows 38 made of a suitable material, for example soft rubber, held in position at one end by spring 37 and trapped at the other end by retaining ring 39, encloses and protects spring 37.

Furthermore, it would be possible to combine the arrangements described in FIGS. 1 and 2.

In this specification the term semi-mobile compound means an organic or inorganic highly viscous liquid, the viscosity being such in relation to the possible leakage paths in the connector, particularly in the region of the diaphragm, that such leakage will be minimal. Normally the viscosity will be in excess of 10,000 centistokes in the temperature range 0°–30°C — the lower the viscosity the greater will be the risk of leakage although the tendency for cavitation to occur around the socket pins during plugging and unplugging will be less owing to the greater ability of the liquid to flow.

I claim:

1. An electrical connector comprising: mating first and second connector members; said first connector member being provided with at least one electrically conducting pin extending therefrom; said second connector member having means defining a cavity therein said cavity defining means including a movable element; an electrical socket in said second connector member extending into one end of said cavity and being engageable with said pin when said connector members are mated; a diaphragm closing the other end of said cavity, said diaphragm being penetrable by said pin during mating of said first and second connector members; said cavity being filled with a semi-mobile nonelectrically-conducting compound; and pressurizing means exposed to said cavity for automatically reducing the volume of said cavity to compensate for any loss of said compound from said cavity during normal usage of the connector, said pressurizing means including said movable element and resilient means biasing said movable element toward said cavity, said pressurizing means comprising a cylinder in said second connector member, said cylinder opening into said cavity, said movable element comprising a piston slidable in said cylinder; and said resilient means biasing said piston in said cylinder toward said cavity.

2. A connector as set forth in claim 1 wherein:

said cylinder opens outside of said second connector member; and pulling means is attached to said piston and extends outside of said second connector member through said cylinder for retracting said piston in opposition to said resilient means.

3. A connector as set forth in claim 1 including:

means extending outside of said second connector member for remotely moving said piston.

4. An electrical connector comprising:

mating first and second connector members;

said first connector member being provided with at least one electrically conducting pin extending therefrom;

said second connector member having means defining a cavity therein;

an electrical socket in said second connector member extending into one end of said cavity and being engageable with said pin when said connector members are mated;

a diaphragm closing the other end of said cavity, said diaphragm being penetrable by said pin during mating of said first and second connector members;

said cavity being filled with a semi-mobile nonelectrically-conducting compound;

said first connector member including a sleeve defining a chamber dimensioned to telescopically fit around the wall of said second connector member;

a second diaphragm mounted adjacent to the bottom of said chamber through which said pin passes; and a semi-mobile nonelectrically conducting compound enclosed between said bottom of the chamber and said second diaphragm.

5. An electrical connector comprising: mating first and second connector members; said first connect or member being provided with at least one electrically conducting pin extending therefrom; said second connector member having means defining a cavity therein said cavity defining means including a movable element; an electrical socket in said second connector member extending into one end of said cavity and being engageable with said pin when said connector members are mated; a diaphragm closing the other end of said cavity, said diaphragm being penetrable by said pin during mating of said first and second connector members; said cavity being filled with a semi-mobile nonelectrically-conducting compound; and pressurizing means exposed to said cavity for automatically reducing the volume of said cavity to compensate for any loss of said compound from said cavity during normal usage of the connector, said pressurizing means including said movable element and resilient means biasing said movable element toward said cavity, said movable element comprising said diaphragm and said resilient means biasing said diaphragm inwardly toward said cavity, said diaphragm being slidable in said cavity; and a bellows connecting said diaphragm to the wall of said cavity.

* * * * *